US005465964A

United States Patent [19]

Thompson

[11] Patent Number: 5,465,964

[45] Date of Patent: Nov. 14, 1995

[54] CURLING HACK

[75] Inventor: Albert N. Thompson, Winnipeg, Canada

[73] Assignee: Thompson Broom Manufacturers Ltd., Winnipeg, Canada

[21] Appl. No.: 979,880

[22] PCT Filed: Aug. 15, 1991

[86] PCT No.: PCT/CA91/00284

§ 371 Date: Mar. 1, 1993

§ 102(e) Date: Mar. 1, 1993

[87] PCT Pub. No.: WO92/03193

PCT Pub. Date: Mar. 5, 1992

[30] Foreign Application Priority Data

Aug. 15, 1990 [CA] Canada ..... 2023342

[51] Int. Cl.[6] ..... A63B 67/14; A63C 19/10

[52] U.S. Cl. ..... 273/126 R; 273/128 R

[58] Field of Search ..... 273/126 R, 128 CS, 273/176 H, 195 A; 482/19, 79

[56] References Cited

U.S. PATENT DOCUMENTS

| | | | |
|---|---|---|---|
| 1,793,898 | 2/1931 | Barron | 482/19 |
| 2,004,172 | 6/1935 | Niday | 482/19 |
| 2,505,784 | 5/1950 | Miller | 482/19 |
| 2,534,159 | 12/1950 | Brouwer et al. | 482/19 |
| 3,401,931 | 9/1968 | McCafferty et al. | 482/19 |
| 3,746,335 | 7/1973 | Fichter et al. | 482/19 |
| 3,799,542 | 3/1974 | Potgieter . | |
| 4,089,519 | 5/1978 | Newton, Jr. | 482/19 |

FOREIGN PATENT DOCUMENTS

| | | | |
|---|---|---|---|
| 876293 | 7/1971 | Canada . | |
| 2507468 | 9/1976 | Germany | 482/19 |

OTHER PUBLICATIONS

Brochure–"The Marco Hack", 1987.

Canadian Design Registration No. 60,188, Registered Feb. 1988.

*Primary Examiner*—V. Millin

*Assistant Examiner*—Raleigh W. Chiu

*Attorney, Agent, or Firm*—Murray E. Thrift; Adrian D. Battison; Stanley G. Ade

[57] ABSTRACT

A curling hack has a base made of a fire retardant plastic material and a replaceable grip pad with ends fixed to the top of the base. A mating groove and rib arrangement on the base and pad provide a resilient, cushioning effect. The grip pad is a soft, high friction material. The back of the hack is supported on the floor by adjustable height columns. The top surface of the hack is configured without a notch between the horizontal front surface and the upwardly sloping back surface.

16 Claims, 2 Drawing Sheets

CURLING HACK

FIELD OF THE INVENTION

The present invention relates to curling hacks.

BACKGROUND

The curling hack is a foothold secured to the ice of a curling rink. Present day hacks are conventionally rubber-lined cups sunken into the ice. The design of the conventional hack has remained substantially unchanged for over 50 years. A recent modification of the conventional design, the "Marco Hack", provides an extended length, slightly convex, sloping rear tread surface and a reduced size notch between the rear tread surface and the front flat surface. Both of these hacks suffer from certain disadvantages. These include a limited contact area with the shoe sole in actual use, as can be demonstrated by the wear pattern on the tread surfaces. The known hacks are also made of a relatively hard rubber, which is necessary in order to provide adequate wear resistance. However, the hard rubber has a relatively low coefficient of friction, especially at low temperatures, so that foot slippage can occur. The known hacks are also prone to the collection of ice and debris in the notch formed between the two tread sections.

The present invention is concerned with various aspects of a novel hack that deal with these and other problems of the prior an devices.

SUMMARY

According to one aspect of the present invention there is provided a curling hack comprising:

a base adapted to be anchored in a sheet of ice;

a grip pad of a material having a high coefficient of friction at low ambient temperatures; and means for detachably securing the grip pad to a top surface of the base.

Because the removeable grip pad is made of a high friction material, for example natural rubber, it will tend to wear more rapidly than the known hacks, however, the pad is replaceable at relatively low cost, so that the service life of the base unit is significantly greater. Natural rubber or another elastomeric material with similar high friction and low temperature sensitivity properties is preferred. A hardness in the range 30 to 70 Durometer is appropriate, with the preferred range being 40 to 70, or possibly more where conditions of use require better physical resistance to damage.

The grip pad may be designed to provide a cushioning action on the sole of the foot, so that the relatively soft pad conforms more readily to the sole of a shoe and increases the surface area of the sole that is in engagement with the hack.

According to another aspect of the present invention there is provided a curling hack comprising:

a base with a front end and a back end;

anchor means adapted to be frozen into a body of ice; and support means extending between the anchor means and the base and supporting the back end of the base above the anchor means, the support means including adjustment means for adjusting the height of the base with respect to the anchor means.

The conventional technique for varying hack height is with wooden blocks placed between the back of the hack and the sand base or concrete floor below the ice. This means that to adjust hack height, it is necessary to remove the hack, install a new block and then reinstall the hack. With the present arrangement, the hack can be adjusted without removal. Height is infinitely variable between maximum and minimum limits. It is preferred that the base is made from a fire resistant material, for example a glass filled polyester, so that heat can be applied to the hack with a torch to melt the ice around the hack and allow its adjustment.

Preferably, the hack has a minimum height slightly less than two inches, say one and thirteen sixteenth inches, and a maximum height of under three inches, say two and three quarters inches. The low height limits exposure of the hack to damage and potential interference with players.

According to another aspect of the present invention there is provided a curling hack comprising a base including a front end and a back end, a first top surface portion extending rearwardly from the front end and a second top surface portion extending from the first portion towards the back end, the first and second portions meeting along a line extending laterally of the hack.

This eliminates the notch that is conventionally found between the horizontal surface at the front and the sloping back tread surface of a hack. The notch tends to collect ice and debris, and is difficult to clean out.

According to a further aspect of the present invention there is provided a curling hack comprising a tread surface and a peripheral frame around the tread surface, the frame having a beveled top, outer edge thereon.

In flooding the ice, the beveled edge of the frame may be engaged with a mating surface on a flooding cup, in order to prevent water ingress to the hack.

According to a further aspect of the invention, a flooding cup for this purpose is provided.

BRIEF DESCRIPTION OF THE DRAWINGS

In the accompanying drawings, which illustrate an exemplary embodiment of the present invention.

DETAILED DESCRIPTION

Figure 1:
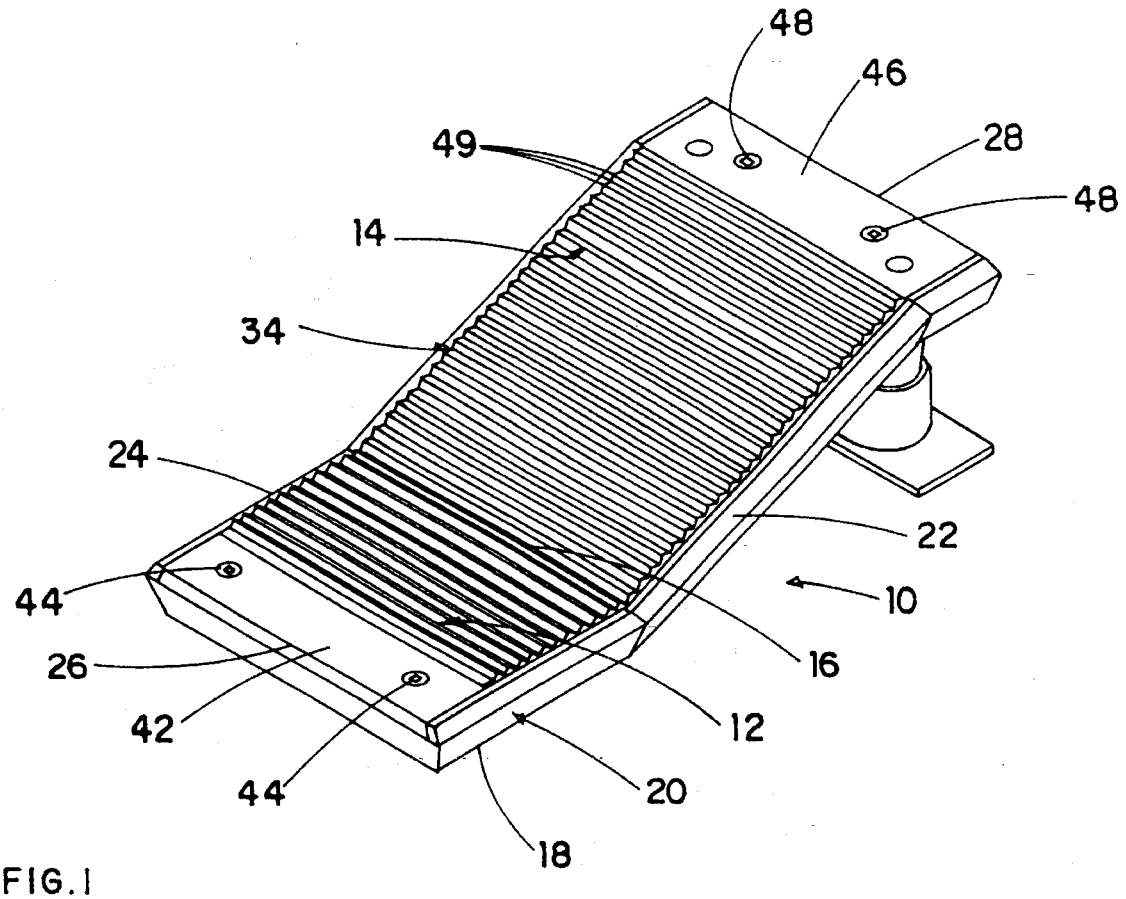
FIG. 1 is an isometric view of a curling hack according to the present invention.

Referring to the drawings, there is illustrated a curling hack 10 with a substantially horizontal front tread surface 12 and a upwardly sloping back tread surface 14. The two surfaces meet along a lateral line 16 that extends from side to side of the hack.

Figure 2:
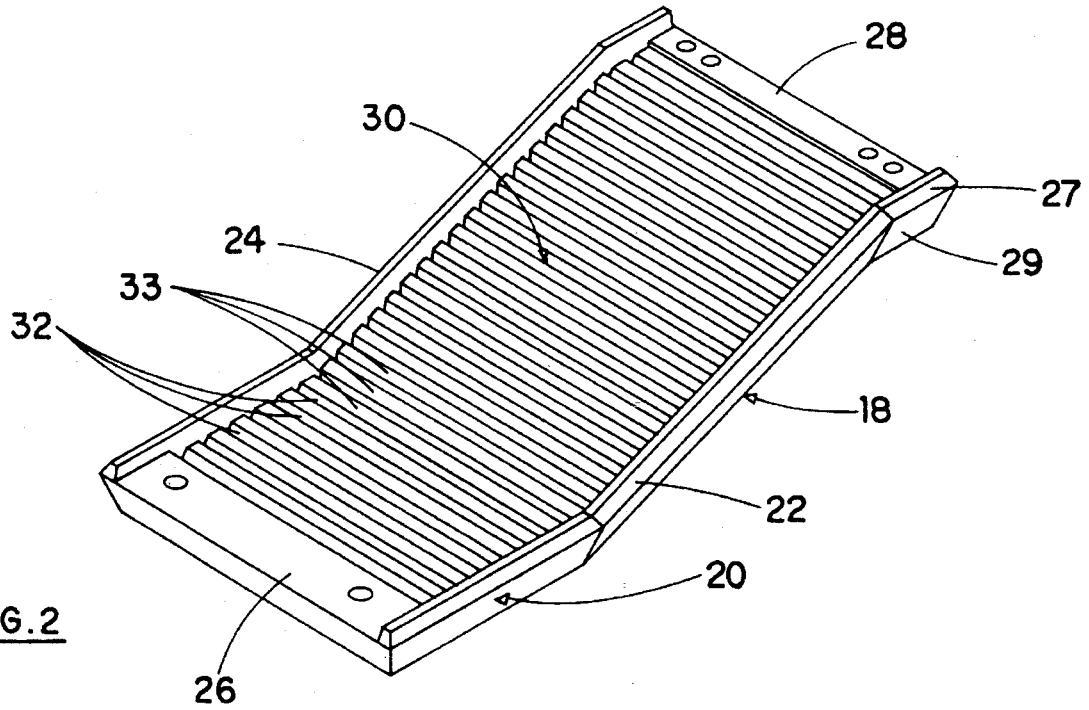
FIG. 2 is an isometric view of the hack base, the grip pad being removed.
Figure 3:
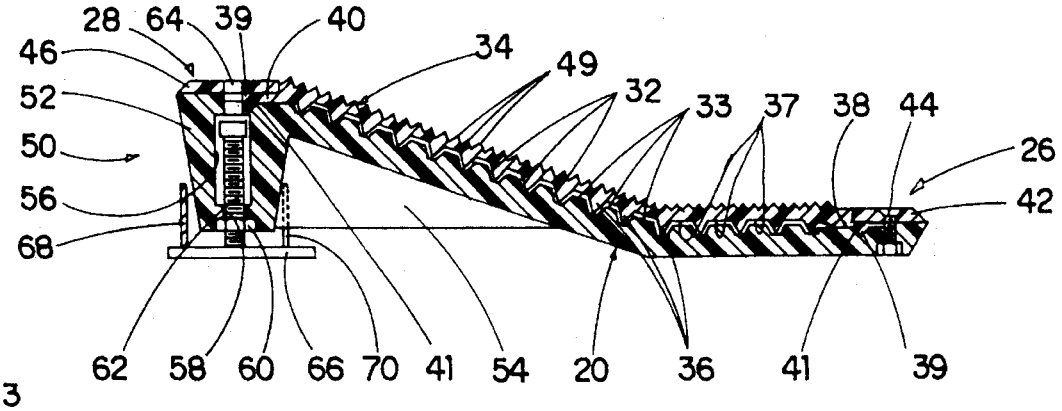
FIG. 3 is a longitudinal section along line III-III of FIG. 1.

The hack has a base component 18 that is most particularly illustrated in FIGS. 2 and 3. This is molded from a glass-filled polyester material that is rigid, resistant to physical damage and also fire resistant. The base is molded with a peripheral frame 20 that includes two side rails 22 and 24, a rail 26 along the front end and a back end rail 28. Each of the rails has an outer side including upper and lower faces 27 and 29, which taper inwardly towards the top and bottom respectively of the rail. These key into the ice to assist in holding the hack steady.

The frame 20 surrounds a recessed support surface 30 with a front horizontal part and an upwardly sloping back part. The support surface is formed with a series of parallel grooves 32, which extend from side to side of the support surface. Each groove has a flat bottom, and divergent sides. The grooves are separated by flat lands 33. The lands along the horizontal front part of the Support surface lie in a common plane, while the lands along the back part of the support surface lie in another, upwardly sloping plane at an angle of 19° to the plane of the front part.

The base 18 supports a grip pad 34 in the form of a sheet of natural rubber with a hardness greater than 40 Durometer. The grip pad fits onto the support surface 30. Triangular ribs 36 molded onto the bottom, of the grip pad fit loosely into the respective grooves 32, as most particularly illustrated in FIG. 3. The ribs are deeper than the grooves so that the flat surfaces 37 between the ribs are positioned above the land 33. This allows a resilient deformation of the ribs into the grooves to provide a cushioning effect when stepped on.

The grip pad has two end tabs 38 and 40 that extend beyond the front and back of the support surface 30. These are offset downwardly and have short v-shaped ribs 39 that fit into mating grooves 41 in the base. The end tab 38 is removably attached to the front of the base by a clamp plate 42 and two screws 44 that hold the clamp plate in place. The end tab 40 is likewise secured to the back of the base by a clamp plate 46 and a pair of screws 48.

The top surface of the grip pad is formed with lateral v-shaped ribs 49 that extend from side to side of the pad. These ribs have an included angle of 80°, the installed state, their roots are positioned slightly above the top of the frame 20.

Figure 4:
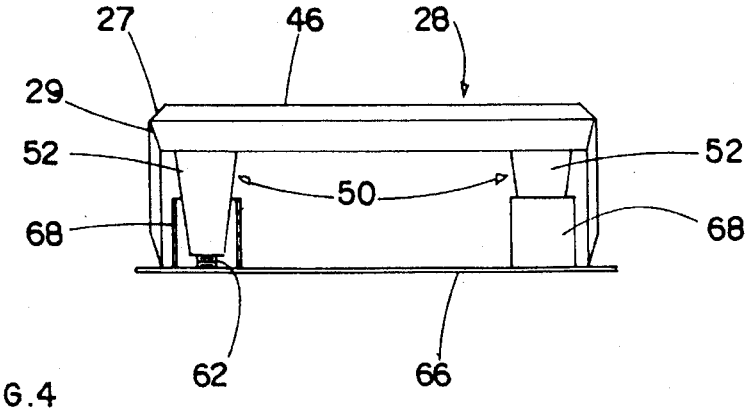
FIG. 4 is a back elevation of the hack illustrating the adjustment mechanism.

As illustrated most particularly in FIGS. 3 and 4, the back of the hack is supported on two columns 50. Each column includes a downwardly tapered leg 52 integrally moulded with the base 18 and joined to the bottom of the base by a gusset plate 54. Each leg has a hollow core 56 communicating with a bore 58 in the bottom of the leg. The bore leads to a nut 60 moulded in the leg. A cap screw 62 is accommodated by the core 56 and threaded into nut 60. An access opening 64 in the top of the base allow the screw to be rotated by a tool, e.g. a screw driver or allen key, engaged with the screw through the access opening 64. Consequently, the height of the hack can be adjusted without removing the hack from the ice. The end of the cap screw is seated on an anchor plate 66 carrying two guide tubes 68 that engage over the tapered legs 52. Each tube 68 has a slot 70 to accommodate the gusset 54 associated with the respective leg.

Figure 5:
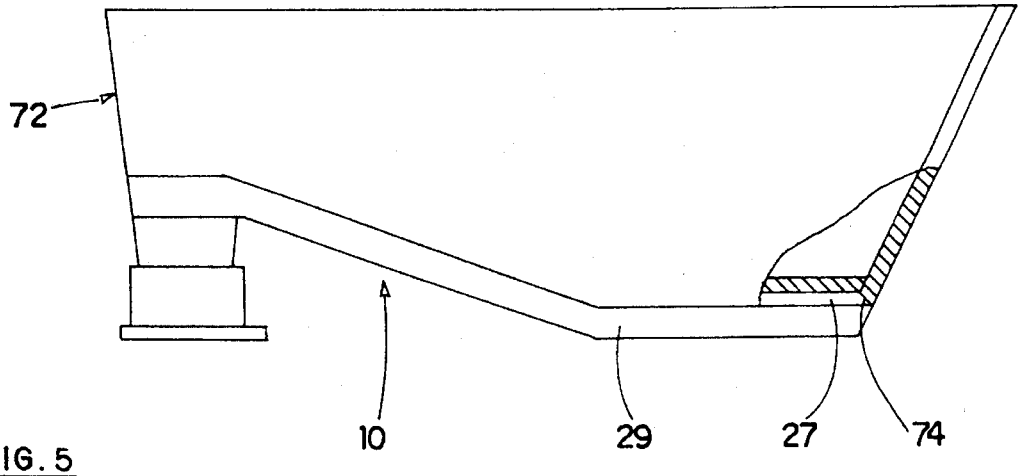
FIG. 5 is an elevation, partially broken away, showing the hack and a flooding cup associated therewith.

As illustrated most particularly in FIG. 5, the hack may be used in conjunction with a flooding cup 72 that has the same outline shape as the frame of the hack. The cup is a hollow cup with a bevelled lower edge 74 that mates with the bevelled top, outer edges 27 along the sides, front and back of the hack. When the flooding cup is installed on the hack and the rink flooded, there will be little or no water ingress into the hack. The cup 72 is made of a material that can be heated to release it from the frozen ice.

A curling hack structured according to this preferred embodiment has a number of advantages over the prior art.

The replaceable grip pad, which has a has coefficient of friction and low temperature sensitivity provides an excellent foot grip. Because it is replaceable, only the grip pad portion of the hack need be replaced when it is worn. In the illustrated embodiment, the grip pad is symmetrical and can be turned end to end when one end is worn. This effectively doubles the life of the pad. Pads can be made with different hardnesses to suit the requirements of different rinks.

The rib arrangement on the underside of the grip pad provides a cushioning effect on the tread surface of the hack to provide better foot support.

The linear, side to side ribs on the top surface of the grip pad eliminate corners so that ice chip and debris will not be trapped in the hack.

The hack height is adjustable to accommodate different ice thicknesses and desired hack heights.

The hack has a low overall height so that need not project too far above the finished ice surface, something that can lead to hack damage from ice surfacing equipment. Excessive hack height can also interfere players.

The overall shape of the hack improves the area of shoe contact with the tread surface of the hack.

The hack material is resistant to physical damage and fire resistant so that it can be heated for removal or adjustment.

The flooding cup seals around the beveled edge of the hack base to prevent water ingress.

I claim:

1. A curling hack comprising:

a base adapted to be anchored in a sheet of ice;

a grip pad of a material having a high coefficient of friction at low ambient temperatures; and means comprising interengaging formations on a top face of the base and a bottom face of the grip pad for detachably securing the grip pad to a top surface of the base.

2. A hack according to claim 1 wherein the interengaging formations comprise a plurality of grooves in the top face of the base and a plurality of ribs on the bottom face of the grip pad, the ribs being resiliently engageable in the grooves.

3. A hack according to claim 2 wherein the base has a front end, a back end and spaced apart sides, and the grooves extend from side to side of the base.

4. A hack according to claim 3 wherein the grooves are parallel.

5. A hack according to claim 1 wherein the grip pad comprises a resilient material.

6. A hack according to claim 2 wherein the grip pad comprises an elastomeric material.

7 A hack according to claim 3 wherein the grip pad comprises natural rubber.

8. A hack according to claim 1 wherein the base has a front end and a back end, the grip pad has a front end and a back end and the means for detachably securing the grip pad to the base further comprise clamp means for clamping the front and back ends of the grip pad to the front and back ends respectively of the base.

9. A hack according to claim 1 wherein the grip pad comprises a plurality of ribs on a top surface thereof.

10. A hack according to claim 11 wherein the ribs are linear and extend from side to side of the grip pad.

11. A hack according to claim 1 wherein the grip pad is symmetrical and may be turned end to end on the base.

12. A curling hack comprising:

a base adapted to be anchored in a sheet of ice, the base having a front end and a back end;

a grip pad of a material having a high coefficient of friction at low ambient temperatures, the grip pad having a front end and a back end; and clamp means for clamping the front and back ends of the grip pad to the front and back ends respectively of the base, the clamp means comprising clamp plates and means for detachably securing the clamp plates to the base.

13. A curling hack comprising:

a base with a front end and a back end;

anchor means adapted to be frozen into a body of ice; and support means comprising a plurality of adjustable height columns extending between the anchor means and the base, for supporting the back end of the base above the anchor means, and for adjusting the height of the back end of the base with respect to the anchor means.

14. A hack according to claim 13 wherein each column comprises a screw and including tool access apertures in the base, aligned with the screws such that the height of the base with respect to the anchor means can be adjusted with the hack installed in a body of ice.

15. A hack according to claim 13, wherein the base comprises a fire retardant material.

16. A hack according to claim 13, wherein the base comprises a glass filled polyester material.

17. A hack according to claim 13, wherein the base comprises a glass filled polyester material.

* * * * *